United States Patent [19]

Kenny

[11] Patent Number: 4,513,785

[45] Date of Patent: Apr. 30, 1985

[54] CONTROLLING ENGINE IDLE

[75] Inventor: Andrew A. Kenny, Roselle, Ill.

[73] Assignee: Eaton Corporation, Cleveland, Ohio

[21] Appl. No.: 438,077

[22] Filed: Nov. 1, 1982

[51] Int. Cl.[3] ..... F15B 13/06

[52] U.S. Cl. ..... 137/881; 123/339; 137/DIG. 8

[58] Field of Search ..... 137/625.65, 881, DIG. 8; 123/339, 341

[56] References Cited

U.S. PATENT DOCUMENTS 4,211,257 7/1980 Sakakibara et al. ..... 137/625.65

4,223,651 9/1980 Eshelman et al. ..... 137/625.65 X

*Primary Examiner*—Gerald A. Michalsky

*Attorney, Agent, or Firm*—C. H. Grace; R. A. Johnston

[57] ABSTRACT

A dual vacuum control signal generator (10) is supplied by separate vacuum sources (34, 85) and employes a solenoid coil operative upon receipt of modulated pulses (148) for switching a valve member (192) between opposing vent seats (142, 196) for controlling venting to create plural vacuum output control signals supplied to connectors (16, 14) for connection through conduits (68, 78) to separate vacuum actuators (60, 70) for individually controlling the position of engine carburetor fuel metering rod (49) and idle mode throttle position cam (88).

11 Claims, 6 Drawing Figures

Fig. 6
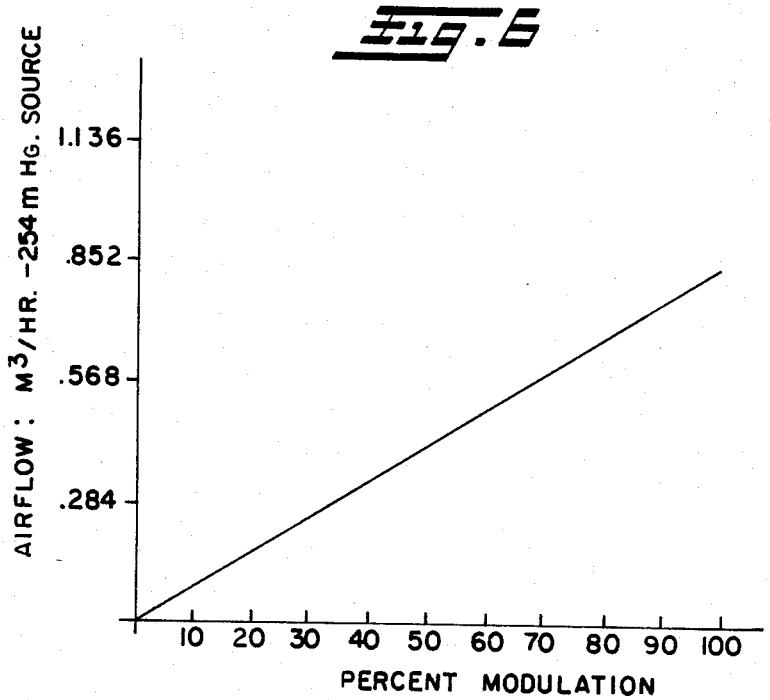
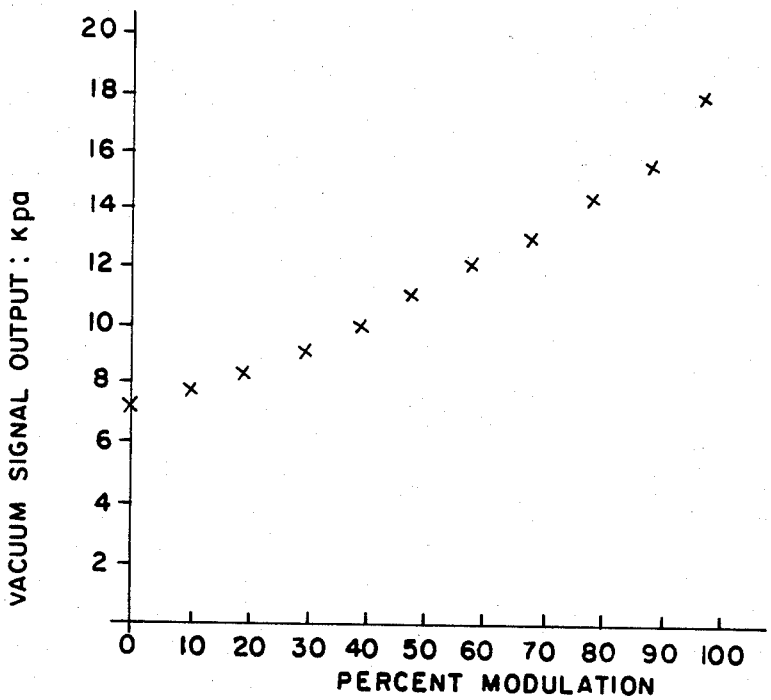
Fig. 5

CONTROLLING ENGINE IDLE

BACKGROUND OF THE INVENTION

The present invention relates to carburetor control for use with internal combustion engines and, particularly, engines for automotive vehicles.

In order to meet the requirements for control of engine exhaust emissions in automotive vehicles, it has been found necessary to provide sensors for various engine conditions such as, for example, coolant temperature, exhaust oxygen concentration and engine induction manifold pressure and to process such sensed engine operating parameters in an on-board computer, in accordance with predetermined relationships, for providing electrical control signals for energizing servoactuators for affecting movement of engine controls.

In particular, it has been found necessary to accurately control fuel-air mixture ratio and engine speed during idle mode operation. Control of the fuel air mixture ratio during idle mode operations has heretofore been accomplished in the carburetor by means of moving fuel metering rods. Control of the position of the throttle in idle mode has been effected by use of a stepped cam moveable to provide various limit positions for closing of the throttle.

Heretofore, where it has been desired to vary the fuel metering and closed throttle position at idle, separate control systems have been utilized, with each control system responsive to an individual electrical control signal provided by the on-board computer responsive to inputs from the various engine operating parameter sensors.

Where electrical control signals are provided for controlling automotive engine fuel metering and throttle position at idle, it has been found impractical to employ electrical servoactuators for physically moving the metering rod and controlling the throttle cam stop position. Electromechanical or electrical servocontrol mechanisms have been found to be complex and prohibitively costly for providing the desired forces required and position control. However, it has been found satisfactory and convenient to employ fluid pressure-operated actuators for moving the closed throttle position cam and the idle mode fuel metering rod. In particular, it has been found desirable to employ vacuum servoactuators for moving the fuel metering rod and throttle position cam devices since a source of on-board vacuum is conveniently available from the engine induction system.

Thus, it has been long desired to provide a vacuum actuated control system for controlling the fuel metering rod at idle and the closed throttle position cam in response to an electrical signal from the on-board computer. In particular, it has been desirable to find a way or means of combining the control of the fuel metering rod and throttle position cam at idle from a common fluid pressure or vacuum control device responding to a single electrical signal input from the on-board engine control computer.

SUMMARY OF INVENTION

The present invention provides a solution to the above-described problem of controlling automotive engine fuel metering and closed throttle position in the idle mode. The present invention employs a vacuum pressure regulator to provide a regulated vacuum output signal derived from the engine induction system vacuum. The input vacuum signal is modified by controlled atmospheric venting, and an output control signal is provided which is applied individually to separate vacuum servoactuators for moving the idle mode throttle position cam and the fuel metering rod for control of fuel air mixture ratio at cruise speeds and idle cam position at idle.

The present invention employs an electromagnetically actuated vent valve for controlling the venting or bleeding of atmospheric air to (a) control pressure chamber for determining the level of the vacuum output signal to the individual vacuum servoactuators. The electromagnetic valve is pulsed by a series of width-modulated pulses which determine the dwell time of a vacuum valve between vacuum switching orifices which control the venting and porting of the vacuum control signal to the individual servoactuators.

Thus, the present invention combines in a unique control device the ability to receive a single electrical control signal and to control the level of vacuum signal to two individual vacuum servoactuators for separately controlling a carburetor closed throttle position cam and the position of a mode fuel metering rod.

BRIEF DESCRIPTION OF THE DRAWINGS

FIG. 5 is a graph of vacuum signal output to the fuel metering servoactuator plotted as a function of percentage modulation of the electrical control signal; and, FIG. 6 is a graph of atmospheric bleed-air flow plotted as a function of perentage modulation of the electrical control signal.

DETAILED DESCRIPTION

Figure 1:
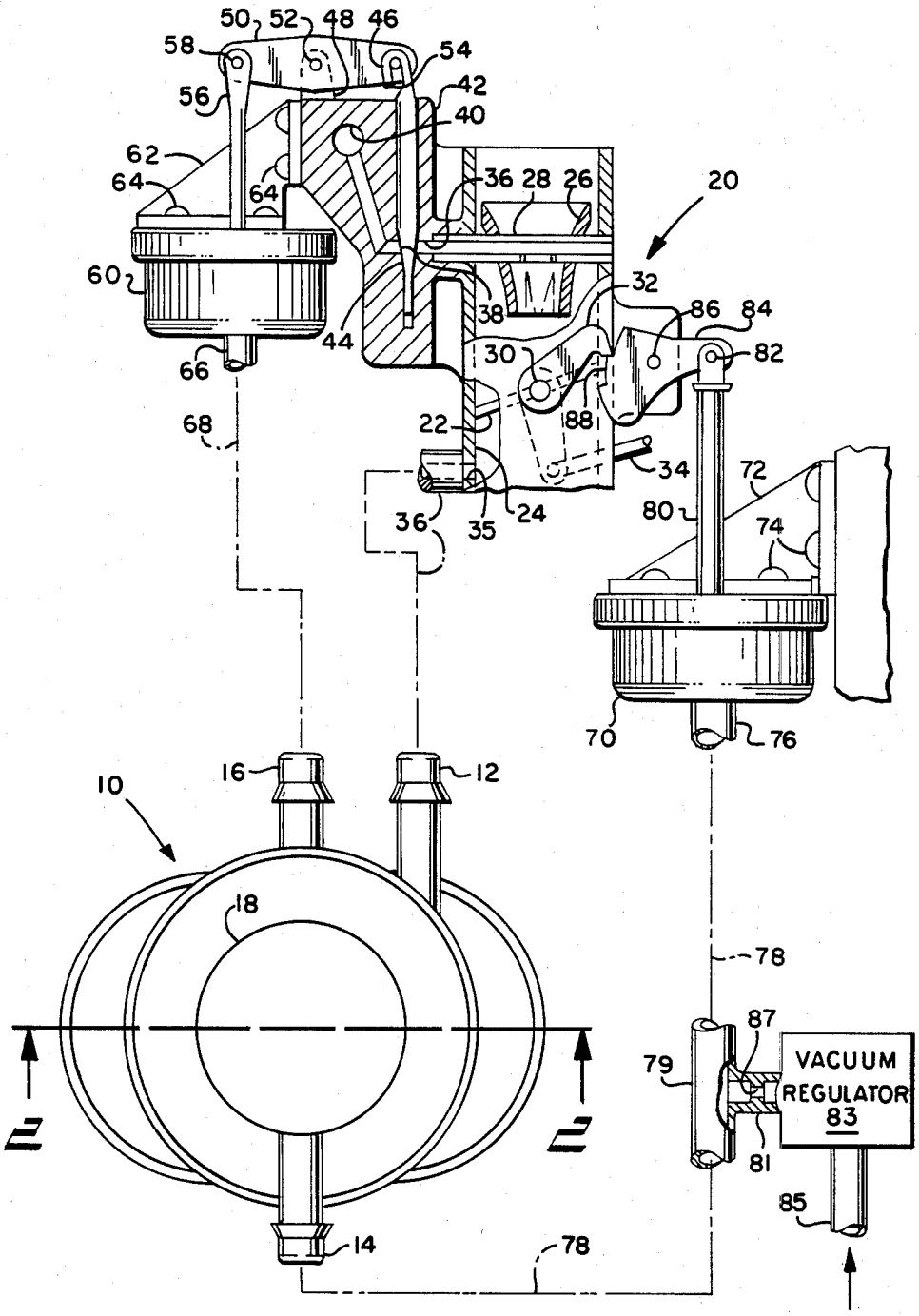
FIG. 1 is a pictorial schematic of the vacuum conduit connection for the system of the present invention as applied to an engine carburetor.

Referring now to FIG. 1 the dual vacuum control signal generator of the present invention is indicated generally at 10 as having a vacuum source connection fitting 12 disposed on one side thereof and a first control signal output fitting 14 disposed on the side opposite the vacuum source connection fitting and as a second control signal output fitting 16 provided thereon adjacent to vacuum source inlet fitting 12. An atmospheric air bleed inlet is provided beneath the covered cap 18 disposed on the end thereof as will be hereinafter described.

A carburetor for an internal combustion engine is indicated generally at 20 and has a butterfly throttle plate 22 pivotally mounted within the induction passage 24. A venturi 26 and fuel spray bar 28 are disposed vertically above the throttle for effecting atomization of fuel delivered to the spray bar.

Throttle 22 is mounted for rotation in the passage 24 on a shaft 30 which has an idle position pawl 32 mounted thereon for rotation therewith and disposed externally of the passage 24 as shown in solid outline in FIG. 1. A throttle actuating rod 34 is attached to the throttle shaft 30 by an intermediate bell crank shown in dash outline for effecting normal engine operating control of the throttle 22.

An induction passage vacuum supply port 35 is provided in the wall of the passage 24 and is connected by means of a suitable conduit 36 such as a flexible vacuum hose indicated by the dashed line in FIG. 1, to the vacuum source connector 12 of the signal generator 10.

The carburetor spray bar 28 communicates with a carburetor fuel metering passage 36. The metering passage 36 is intersected by a tapered bore 38 and is supplied by a connection to a fuel supply gallery 40 provided in the body 42 of the carburetor.

A tapered metering rod 44 is slideably received in the bore 38 for vertical movement therein. The metering rod 44 has a tapered portion configured to closely interfit and conform to the tapered portion of the bore 38 and the upper end of rod 44 has an attachment hook 46 provided thereon.

A pivot stanchion 48 is provided on the carburetor and has a link 50 pivotally mounted thereon about pin 52. A pivot lug 54 is provided on one end of link 50 with a hook portion 46 of the metering rod received thereover. Rod 56 is connected to pressure responsive servoactuator 60 mounted to the carburetor body by means of mounting bracket 62 and suitable fasteners 64. The servoactuator may be of any suitable construction well known in the art such as the type employing a flexible diaphragm device. Actuator 60 has a vacuum signal inlet connector 66 provided thereon which connected via conduit 68, indicated by dashed line in FIG. 1, to the signal outlet connector 16 of the dual signal generator 10.

A second vacuum actuator 70 is provided and is attached to a mounting bracket 72 secured to any convenient portion of the engine structure or extended portion of carburetor body 42 by suitable fasteners 74. The vacuum actuator 70 has a signal port inlet connector 76 which is connected via a suitable conduit 78, such as a flexible vacuum hose indicated by dashed outline in FIG. 1 to the vacuum signal output connector 14 of the signal generator 10.

The vacuum actuator 70 has a movable output actuator rod 80 with extension therefrom having the remote end thereof connected by suitable pin connection 82 to a pivoted link 84 mounted on the carburetor body structure for pivotal movement about a pin 86. The end of link 84 opposite the pin 82 has a stepped cam 88 provided thereon for engagement of the idle pawl 32.

A tee fitting 79 is provided in vacuum line 78 and has the branch 81 thereof connected to a vacuum regulator 83 receiving a vacuum signal at its inlet fitting 85 as indicated by the solid black arrow in FIG. 1. Any suitable on-board source of vacuum (not shown) may be employed as, for example, engine induction manifold vacuum or output from a vacuum pump.

A flow restricting control orifice 87 is provided in branch 81 for limiting atmospheric vent flow, as will be hereinafter described, to the regulator 83 to a desired amount.

Figure 2:
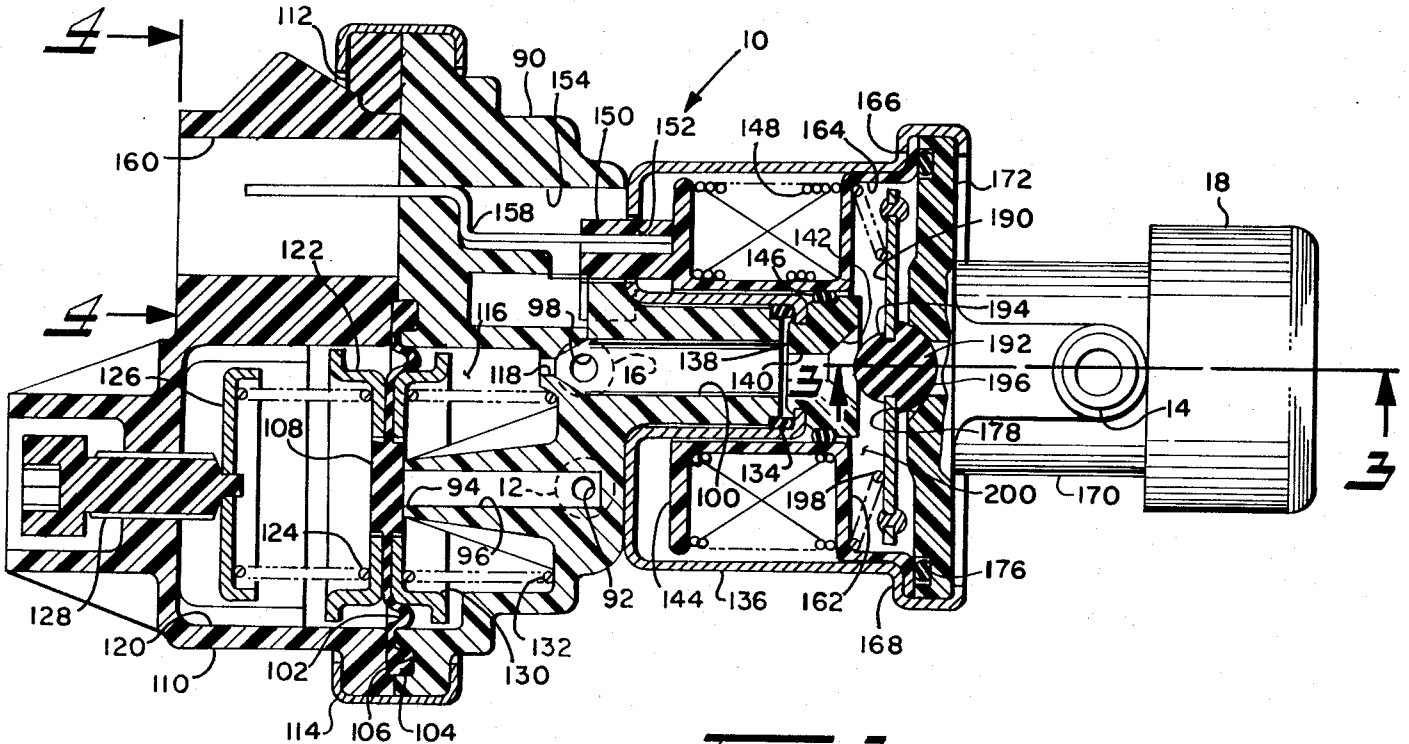
FIG. 2 is a section view taken along section-indicating lines 2—2 of FIG. 1.
Figure 3:
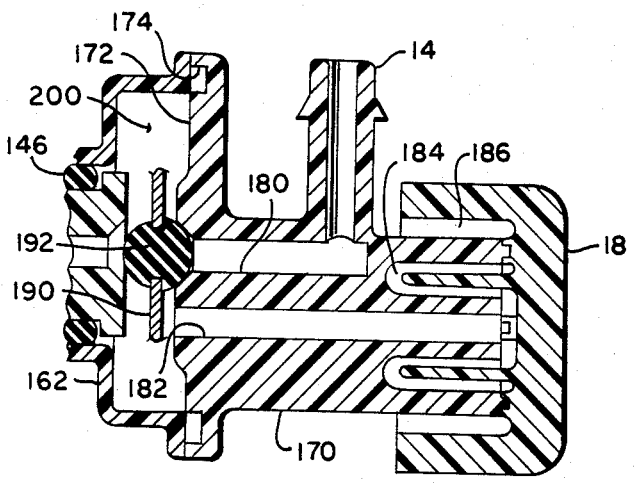
FIG. 3 is section view taken along section-indicating lines 3—3 of FIG. 2.
Figure 4:
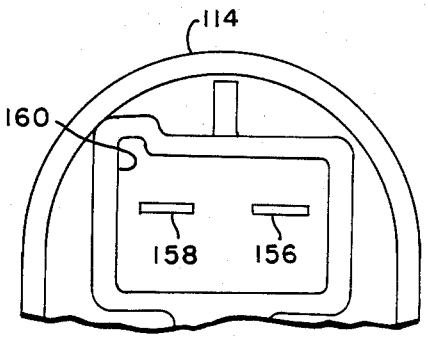
FIG. 4 is a view taken along lines 4—4 of FIG. 2.

Referring now to FIGS. 2, 3 and 4 the dual vacuum signal generator 10 of the present invention is illustrated in greater detail as having a base 90 having the connectors 12, 16 formed thereon with the connector 12 having a port 92 communicating with a vacuum valve sealing surface 94 via passage 96. The connector 16 has a vacuum signal port 98 provided therethrough which communicates with a vacuum signal chamber 100.

A resilient pressure responsive diaphragm 102 has a peripheral bead 104 which is sealed about the base 90 in a groove 106 provided therein. The central region of the diaphragm 102 comprises a valve pad 108 which is movable for sealing against the valve sealing surface 94.

The diaphragm is sealed about the peripheral bead 104 by a cover portion 110 along a parting line with the body 90. Cover portion 110 has an outer peripheral flange 112 which is clamped against the body 90 by a circumferential clamping ring 114 crimped thereover. The diaphragm 102 creates an annular vacuum signal chamber 116 about the valve sealing surface 94, which chamber 116 communicates with the chamber 100 by means of a restricting orifice 118 formed in the body 90.

The cover 110 has a cavity 120 formed therein surrounding the left-hand face thereof the diaphragm 102, which has a backing plate 122 received and registering against the left-hand face thereof. A compression spring 124 has one end thereof registered against the backing plate with the left-hand end thereof registering against a retaining plate 126 which registers against the end of an adjustment screw 128 threadedly received through the left-hand end of the cover 110.

A corresponding backing plate 130 is provided in the vacuum chamber 116 and is registered against the right-hand face of diaphragm 102 with a second compression spring 132 having one end thereof registered against the plate 130. The right-hand end of spring 132 registers against the wall of the chamber 116 in body 90.

The springs 124, 132 are chosen so as to provide the desired bias against the diaphragm plates 122, 130 to position the diaphragm, as desired, with respect to valve sealing surface 94. The adjustment screw 128 provides a means of varying the pre-load of the springs 132, 124 against the diaphragm. It will be understood that spring 132 has sufficient force to maintain the diaphragm pad 108 initially spaced from the valve sealing surface 94 when the pressure in chamber 116 is atmospheric.

The right-hand end of chamber 100 is sealed by sealring 134 registering in a groove provided about the outer periphery of the right-hand end of base 90, and the inner periphery of an annular cup 136, which sealingly engages a plug 138 received in an aperture formed in the center of the cup 136. Plug 138 has a central vacuum bleed aperture 140 provided therethrough and a chamfered valve seat 142 provided on the right-hand end of the aperture 140.

A coil bobbin 144 is received over the central portion of the annular cup 136 and the inner periphery of a bobbin 144 is sealed about the outer periphery of end plug 138 by a second seal ring 146. A coil of suitable magnet-wire 148 is wound about the bobbin 144.

The bobbin has a terminal attachment portion 150 extending from the left-hand flange thereof through an aperture 152 formed in the bottom of annular cup 136 and extending into a cavity 154 provided in the body 90. The terminal receiving portion 150 of the bobbin has received therein a pair of electrical connecting terminals 156, 158 (see FIG. 4), with only terminal 158 being illustrated in FIG. 2.

The terminals 156,158 extend outwardly through the body 90 into a receptacle 160 formed in cover 110. It will be understood that the opposite ends of the coil of wire 148 are attached respectively each to one of the terminals 156, 158 by any suitable means as, for example, soldering, staking or tying.

Referring to FIG. 2 the bobbin 144 has the right-hand end flange 162 thereof formed with the outer periphery thereof turned to extend axially thereby forming a cylindrical portion 164. The free end of cylindrical portion 164 is turned radially outwardly to form rim flange 166 which registers axially against a correspondingly configured shoulder portion 168 formed on the rim of cup 136.

Referring to FIGS. 2 and 3 a vent member 170 has a radially outwardly extending flange 172 provided on the left-hand end thereof, which flange has a circumferential groove 174 formed in the left-hand end face thereof adjacent to the outer periphery with a seal ring 176 received therein. The flange 172 and seal ring 176 register against the right-hand axial face of bobbin flange 166 and are retained thereagainst in fluid sealing engagement by crimping of the outer rim of the shouldered portion 168 of cup 136 in a radially inwardly extending manner and over the outer periphery of the flange 172.

Referring to FIG. 3, the vent member 170 has a vent valve seat 178 formed on the left-hand face of flange 172 which vent seat 178 communicates by means of passage 180 with the port 181 formed in the signal output connector 14. A continuous vent passage 182 is formed through the vent member 170 extending from the left-hand face of flange 172 through to the right end of member 170. Passage 182 communicates with a labyrinth chamber 184 formed beneath the vent cap 18 which is received over the right-hand end of member 170. The labyrinth chamber communicates passage 182 with the atmosphere via the annular space 186 formed between the outer cylindrical wall of cap 18 and the vent member 170.

Referring to FIGS. 2 and 3, a valve plate, or disc, 190 is received between the right-hand flange 162 of the bobbin and the flange 172 of the vent member, and has a resiliant poppet 192 mounted in the central region thereof having generally hemispherical valve seating surfaces 194, 196 on opposite sides thereof. The valve plate 190 is biased in a rightward direction by a conical spring 198 having one end registering against the bobbin end flange 162 and the opposite end registering against the left-hand surface of plate 190. The spring 198 biases the valve plate in a rightward direction tending to cause the poppet sealing surface 196 to seat against vent seat 178.

With reference to FIG. 1, in operation, with normal engine induction passage vacuum applied to fitting 12 and a suitable source of vacuum applied to the inlet 85 of vacuum regulator 83, a vacuum signal is delivered through regulator orifice 87 to tee fitting 79 and vacuum conduit 78 to the inlet fitting 14 of the dual signal controller 10 of the present invention. It will be understood to those having ordinary skill in the art, that the level of vacuum source at regulator inlet 85 is chosen or matched with the effective area of the vacuum actuator 70 so as to provide the desired force output on actuator rod 80. In the presently preferred practice the invention, it has been found satisfactory to employ a vacuum signal input to regulator 83 having a level of 254 millimeters Hg. or 33.77 Kpa. below atmospheric pressure.

With reference to FIGS. 2, 3, and 4, with no electrical signal applied to terminals 158, 156 the valve poppet 194 is in the rightward position shown in solid outline in FIG. 2 under the bias of spring 198 and is seated against sealing surface 178 to close passage 180 thereby preventing communication between port 181 in signal output connector 14 and vacuum vent signal chamber 200. However, it will be understood that chamber 200 is continuously vented through passage 182 via the labyrinth chamber 184 and chamber 186 under the vent cap 18.

Upon receipt of an electrical control signal at terminals 158, 156, coil 148 is energized thereby creating a magnetomotive force on valve plate 190 sufficient to overcome the bias of spring 198. The force causes the valve plate 190 to move leftward unseating poppet 192 from sealing surface 196 and re-seating the left-hand hemispherical surface 194 of the poppet 192 against vent sealing surface 142 formed on the plug 138. With the surface 142 sealed, vent chamber 200 is isolated from chamber 100 and atmospheric vent flow through the plug passage 140 is thereafter prevented. Closure of the passage 140 results in greater vacuum in the chamber 100 due to the vacuum supplied thereto through limiting orifice 118 communicating with the vacuum regulator chamber 116.

The electrical control signal applied to terminals 156, 158 is of the type having a substantially constant frequency duty cycle and pulse with-modulated to have a pulse width between 0 and 100% modulation or between a de-energized coil and a continuously energized coil. At signal modulation other than 0 or 100%, it will be understood that valve plate 190 oscillates so as to alternately seat the poppet 192 against sealing surfaces 178 and 142.

When poppet 192 has the surface 196 thereof spaced from vent sealing surface 196, vent flow is permitted from the continuously vented passage 182 through chamber 200 and through passage 180 into the signal connector 14 and through conduit 78 (see FIG. 1) to vent the vacuum signal from regulator 83 applied through tee 79. With the poppet sealed against surface 178 as shown in solid outline FIGS. 2 and 3, venting of conduit 78 and tee 79 is prevented and the full vacuum signal from orifice 87 is applied through conduit 78 to the servo-actuator 70 for effecting movement of the actuator rod 80.

In the present practice of invention, it has been found satisfactory to choose the orifice 118 between vacuum chambers 116 and 100 in the body 90 to limit the vacuum supply to chamber 100 to a vacuum level of 1140 millimeters Hg., with the valve poppet 192 sealed against vent sealing surface 142 when the coil signal is 100% modulated or the coil is continuously energized.

The passage 140 in vent plug 138 is chosen so as to provide a vacuum signal level of about 380 millimeters Hg. when the coil is de-energized or 0% modulated wherein continuous venting occurs through passage 142 to the chamber 100. It has been found satisfactory to calibrate the signal controller 10 of the present invention with a 50% modulated control signal applied to terminals 158, 156 by turning adjustment screw 128 until a vacuum output control signal having a level of 760 millimeters Hg. below atmospheric is provided through signal output connectors 16 for actuating the fuel-metering servo-actuator 60.

Referring to FIG. 5, the vacuum output signal provided to the conduit 68 and vacuum actuator 60 for controlling idle mode fuel-metering is plotted on the ordinate axis in kiloPascals as a function of electrical control signal percent modulation or duty cycle on the abscissa axis for a typical application of the dual controller 10 of the present invention.

Referring to FIG. 6 the bleed, or vent, air flow through the vent cap labyrinth passage is plotted in cubic meters per hour on the ordinate as a function of electrical control signal percent modulation, or duty cycle, plotted on the abscissa axis for a typical application of the present invention having the control signal output described with reference to FIG. 5.

The present invention thus provides a unique dual valve control signal generator operative upon receipt of a single pulse-with modulated electrical control signal to provide controlled venting of atmospheric pressure to a vacuum bleed chamber to provide separate vacuum output control signals for controlling individual carburetor functions of an internal combustion engine. The present invention provides a unique dual vacuum signal controller for controlling the cruise mode fuel-metering system of an engine carburetor and the idle mode throttle position cam mechanism provided on the engine carburetor.

Although the dual signal controller of the present invention has been hereinabove described with respect to the present practice and the illustrated embodiments, it will be understood by those having skill in the art that modifications in variations of the invention may be made; and, the invention is limited only by the following claims:

I claim:

1. A dual vacuum control signal generator comprising:

(a) housing means defining a vacuum control signal chamber and a supply port therein adapted for connection to a source of vacuum;

(b) means defining a first valving surface in said chamber communicating with said supply port and a pressure responsive valve member moveable with respect to said valving surface for controlling fluid flow thereover between said vacuum chamber and said supply port operative for regulating vacuum level in said chamber about a predetermined level;

(c) means defining a first control signal port communicating with said vacuum chamber;

(d) means defining a venting passage in said vacuum control signal chamber including means defining a second valving surface;

(e) means biasing said pressure responsive valve member and applying a preload thereon;

(f) said housing means including means defining a venting chamber communicating with said venting passage and means defining a vent port communicating said venting chamber with atmospheric pressure;

(g) said housing means including a second control signal port communicating with said venting chamber and including means defining a third valving surface for controlling flow through said second control signal port;

(h) vent valve means moveable between a first position sealing said third valving surface with said second valving surface unsealed, and a second position sealing said second valving surface with said third valving surface unsealed;

(i) means biasing said vent valve means toward said first position;

(j) actuator means operable, upon receipt of an electrical control signal, to move said vent valve means between said first and second positions, wherein upon connection of said supply port to a source of vacuum, a vacuum output signal is provided to said first control signal output port, and upon connection of a regulated vacuum source to said second control signal port and upon said actuator means receiving an electrical control signal said vent valve means moves to control venting to said vacuum control chamber and said second control signal port thereby providing first and second control signals, respectively, to said first and second control signal ports.

2. The device defined in claim 1 further comprising means operable upon adjustment to vary the preload upon said pressure responsive valve means.

3. The device defined in claim 1, wherein said vent valve means includes electromagnetic means with an armature member formed of ferro-magnetic material having a resilient poppet thereon with surfaces thereof disposed opposite side of said member for alternately effecting sealing against said second and third valving surfaces.

4. The device defined in claim 1, wherein said pressure responsive means include a resilient diaphragm.

5. The device defined in claim 1, wherein said means defining said vacuum control signal chamber includes means defining a control orifice operative to control fluid flow between said supply port and said vacuum control signal chamber.

6. The device defined in claim 1, wherein said actuator means includes electromagnetic means having a ferromagnetic armature.

7. The device defined in claim 1, wherein said actuator means includes electromagnetic means having a coil and said vent valve means includes an armature moveable upon energization of said coil.

8. The device defined in claim 1, wherein said actuator means includes an electromagnetic coil with said vacuum control signal chamber disposed at least partially centrally therewithin.

9. The device defined in claim 1, wherein said pressure responsive valve means comprises a resilient diaphragm sealed about the periphery thereof along a parting line in said housing means.

10. The device defined in claim 1, wherein said actuator includes an electromagnetic coil and said vent valve means includes a generally thin flat-plate armature disposed adjacent to one end of said coil and having resilient means defining separate sealing surfaces disposed on opposite sides thereof.

11. The device defined in claim 1 wherein said vent valve means includes a generally thin flat-plate member having resilient sealing surfaces disposed on opposite side thereof with said second and third valving surfaces disposed respectively adjacent said sealing surfaces.

* * * * *